United States Patent [19]

Grabovac et al.

[11] Patent Number: 4,732,062

[45] Date of Patent: Mar. 22, 1988

[54] FLOATING FULCRUM FOR TORQUE WRENCHES

[75] Inventors: Bosko Grabovac, Arcadia; Milan Krunic, Azusa; Zlatko Kurtovic, Walnut, all of Calif.

[73] Assignee: Consolidated Devices, Inc., City of Industry, Calif.

[21] Appl. No.: 3,861

[22] Filed: Jan. 16, 1987

[51] Int. Cl.[4] ..... B25B 23/159

[52] U.S. Cl. ..... 81/483; 81/478

[58] Field of Search ..... 81/483, 478, 467, 480, 81/481

[56] References Cited

U.S. PATENT DOCUMENTS 3,772,942 11/1973 Grabovac ..... 81/483

4,532,836 8/1985 Grabovac ..... 81/483

FOREIGN PATENT DOCUMENTS 966947 8/1964 United Kingdom ..... 81/483

*Primary Examiner*—Frederick R. Schmidt

*Assistant Examiner*—Robert Showalter

*Attorney, Agent, or Firm*—Georges A. Maxwell

[57] ABSTRACT

An adjustable, click-type, torque wrench comprising an elongate tubular arm with front and rear ends, a work engaging head on an axis normal to the axis of the arm, an elongate lever projecting rearward from the head and freely into the arm, a first pivot pin pivotally connecting the front end portions of the lever and the arm together on an axis parallel with the axis of the head, an elongate link with front and rear ends within the arm, a second pivot pin connecting the front end of the link to the rear end of the lever on an axis parallel with the first pivot pin, an elongate fulcrum block slidably engaged in the arm and freely engaged about the link, a fulcrum pin engaged through the block and the link on an axis parallel with the pivot pins to provide for pivotal movement of the link relative to the block, a plunger in the arm rearward from the link, a cam block with flat faces normally in flat engagement with flat opposing cam seats on the link and the plunger; and a spring yieldingly urging the plunger forward with predetermined selected force.

11 Claims, 9 Drawing Figures

FLOATING FULCRUM FOR TORQUE WRENCHES

This invention has to do with a floating fulcrum for torque wrenches.

BACKGROUND OF THE INVENTION

The art of click-type, adjustable torque wrenches is old and highly developed. Such wrenches typically include enlongate tubular lever arms with front and rear ends, manually engagable handles at the rear ends of the arms and work engaging heads at the front ends of the arms. The work engaging heads have elongate work coupling parts with axes normal to the longitudinal axes of the arms. The heads also have elongate rearwardly projecting levers that project freely rearwardly into and through the forward portions of the arms. The forward end portions of the levers are pivotally connected with the front end portions of the arms by pivot pins spaced rearward from and parallel with the axes of the heads and normal to the axes of the arms so that the levers can pivot laterally and into stopped engagement with the interior surfaces of the arms when the heads are drivingly coupled with work to be torqued and the arms are manually pivoted about the axes of the heads.

The rear ends of the levers have rearwardly disposed flat cam seats. The arms carry longitudinally shiftable plungers with flat, forwardly-disposed cam seats spaced from and opposing the cam seats on the levers. Cam blocks with flat, forward- and rearwardly-disposed cam faces are engaged between the noted cam seats and normally established flat seated engagement therewith. Compression springs are engaged in the arms rearward of the plungers to urge the plungers forward so that the cam faces of the cam blocks cooperate with their related cam seats to releasably hold the levers central and in axial alignment with the axes of the arms. Mechanisms are provided to adjust the axial biasing of and pressure exerted by the springs onto and through their related plungers, cam blocks and levers. The forces exerted by the springs determine the turning forces required to be applied onto and through the wrench structures to cause the levers to overcome the holding force afforded by the cam blocks between the plungers and levers and to allow the levers to pivot within the arms. When sufficient force is directed through and between the arms and levers to cause the levers to pivot in the arms, the cam blocks are caused to pivot between the plungers and levers, the plungers shift rearwardly against the resistance of the springs, and the levers pivot laterally and strike the inside surfaces of the arms, generating audible click sounds.

In the art of wrenches of the general character referred to above, there is another, more sophisticated and improved wrench structure which, in addition to the structure recited above, includes an elongate link with front and rear ends positioned within the arm between the lever and the plunger. The front end of the link is pivotally connected with the rear end of the lever by a pivot pin, on an axis parallel with and spaced rearward from the pivotal axis of the lever. The rear end of the link is formed with a rearwardly-disposed cam seat which normally establishes flat engagement with the front cam face of the cam block. The link is pivotally supported between its ends and within the arm by a fulcrum block which is carried by the link and engages the interior bearing surface of the arm. When the arm and lever pivot, that is, when the rear end of the lever is caused to move laterally to one or the other side of the arm, the front end of the link moves laterally within it, pivoting the link about the turning axis of the fulcrum block. Upon pivoting or turning of the link, the rear end thereof moves laterally to the other or opposite side of the arm. The rear end of the link cooperates with the cam block, plunger and spring in the same manner that the levers, cam block, plungers and springs of the first described form of torque wrenches cooperate.

The provision of the above noted link affords a mechanical advantage for the spring of the wrench whereby the spring need not be overworked and whereby a lighter, more durable spring can be employed. Further, by varying the longitudinal position of the fulcrum block on the link, wrenches for operating through many different ranges of operating forces can be made without making any other structural changes or modifications.

The above and last noted wrench structure is the subject matter of and is fully disclosed in U.S. Pat. No. 3,772,942 for "IMPROVED ADJUSTABLE TORQUE WRENCH," issued Nov. 20, 1973 and in U.S. Pat. No. 4,532,836 for "ADJUSTABLE FULCRUM FOR TORQUE WRENCHES," issued Aug. 6, 1985.

While the basic torque wrench structure disclosed in the above noted patents have proven to have many advantages over torque wrenches that do not include the noted link and fulcrum block, it is inherent in those wrenches that, as the levers pivot and cause the links and their fulcrum blocks to pivot in and relative to the lever arms, the fulcrum blocks, in addition to turning or pivoting, are also caused to reciprocate or shift axially short distances within the lever arms, as they pivot or turn therein. Still further, the applied forces or pressures exerted between the fulcrum blocks and the interior bearing surfaces of the arms are ordinarily quite great. As a result of the foregoing special factors inherent in the noted prior art wrench structure, it has been found that the bearing surfaces of the fulcrum block and their opposing bearing surfaces within the arms wear, at an excessive rate, with the result that worn depressions or grooves are formed in the bearing surfaces in the arms and the bearing points or edges of the fulcrum blocks wear into seated engagement in the worn depressions. As such wearing and seating of parts progresses, the ability of the fulcrum blocks to move longitudinally of the arms is impaired and effective, accurate operation of the wrenches is adversely affected. There are instances where such wearing and seating of parts has become so great that the wrenches have been rendered inoperative or their functioning has become so impaired as to render them undependable, if not useless.

In the above noted last-to-be-issued U.S. Pat. No. 4,532,836, wherein a metal bearing ring is engaged about and carried by the fulcrum block, a major reason for adopting and using the noted metal bearing ring was to provide a bearing part of a heat-treated alloy that had superior frictionally and wearing characteristics than could be economically and practically imparted into the fulcrum block itself. While the above proved to be effective with respect to wearing of the fulcrum bearing points for the links, it proved to have opposite and adverse effects with respect to the rate and extent of wear of the bearing surfaces within the arms. Since the special alloy bearing rings did not wear, the wearing forces exerted on the bearing surfaces in the arms remained concentrated and the high pressure turning and scuffing of the bearing ring parts wore deeper and more acute recesses in the bearing surfaces in the arms, at a faster rate.

Another notable shortcoming in the above noted wrenches provided by the prior art resides in the fact that the kind of motion that occurs at the fulcrum bearing points for the links tends to displace any lubricant that might be deposited to affect smooth operation and reduce wear. Also, when a lubricant is used which is less likely to be displaced, it inevitably collects, holds and concentrates foreign matter and the grindings from the worn metal parts, which foreign matter and grindings cause more rapid and severe wear.

OBJECTS AND FEATURES OF THE INVENTION

It is an object of our invention to provide an improved floating fulcrum for the intermediate link in torque wrench structures of the general character referred to above which fulcrum is such that substantially little or no adverse wear occurs at and between the fulcrum block and its opposing interior bearing surface of its related wrench arm.

It is another object and a feature of our invention to provide an elongate cylindrical, tubular fulcrum block which establishes longitudinal sliding bearing engagement with the interior cylindrical bearing surface of its related wrench lever arm whereby the lateral forces directed through the block and onto the inside bearing surface of the arm, by the link, are spread and distributed through longitudinally extending bands of contact between the block and the arm.

It is yet another object and feature of our invention to provide a new and improved floating fulcrum structure of the general character referred to above wherein the effective longitudinal extent of the fulcrum block and of its bands of contact with the bearing surface in its related arm are at least one-half the radius of the block and are therefore such that the block is self-aligning in the arm and does not tend to become misaligned within the arm so as to create any scuffing and/or binding between itself and the arm, and assures relative linear movement between itself and the arm.

Another object and feature of our invention is to provide a floating fulcrum structure of the general character referred to above wherein the link is normally concentric with and extends substantially freely through the block and is pivotally connected therewith by a fulcrum pin engaged transversely through the block and the link.

Still another object and feature of our invention is to provide a novel, floating fulcrum structure of the general character referred to above wherein the block has a longitudinally extending central opening at the axis of the fulcrum pin, which opening establishes close working clearance with the exterior of the pin and maintains said link substantially concentric within the block where the axis of the link and "fulcrum pin" intersect and wherein said central opening has opposite longitudinally outwardly opening radially outwardly divergent or tapered end portions which allow for free pivoting of the link within the block about the axis of the fulcrum pin.

Another object of the invention is to provide a floating fulcrum structure of the character referred to, including lubricating means to maintain the interface between the opposing bearing surfaces of the block and the arm lubricated.

In furtherance of the above, it is an object and feature of our invention to provide lubricating mens which serve to receive and to retain sulfur-free, anhydrous lubricating oil or grease between the block and the arm throughout the effective longitudinal distance of travel therebetween whereby the opposing bearing surfasces are not subject to being oxidized, etched or otherwise damaged by the migration of water therebetween or by the degradation of the lubricant as would be the case if hydrous and/or sulfur-bearing lubricants were used.

The foregoing and other objects and features of our invention will be apparent and will be fully understood from the following detailed description of the invention, throughout which description reference is made to the accompanying drawing.

DETAILED DESCRIPTION OF THE INVENTION

Figures 1, 2, 3, 4, 5, 6, 7, 8, 9:
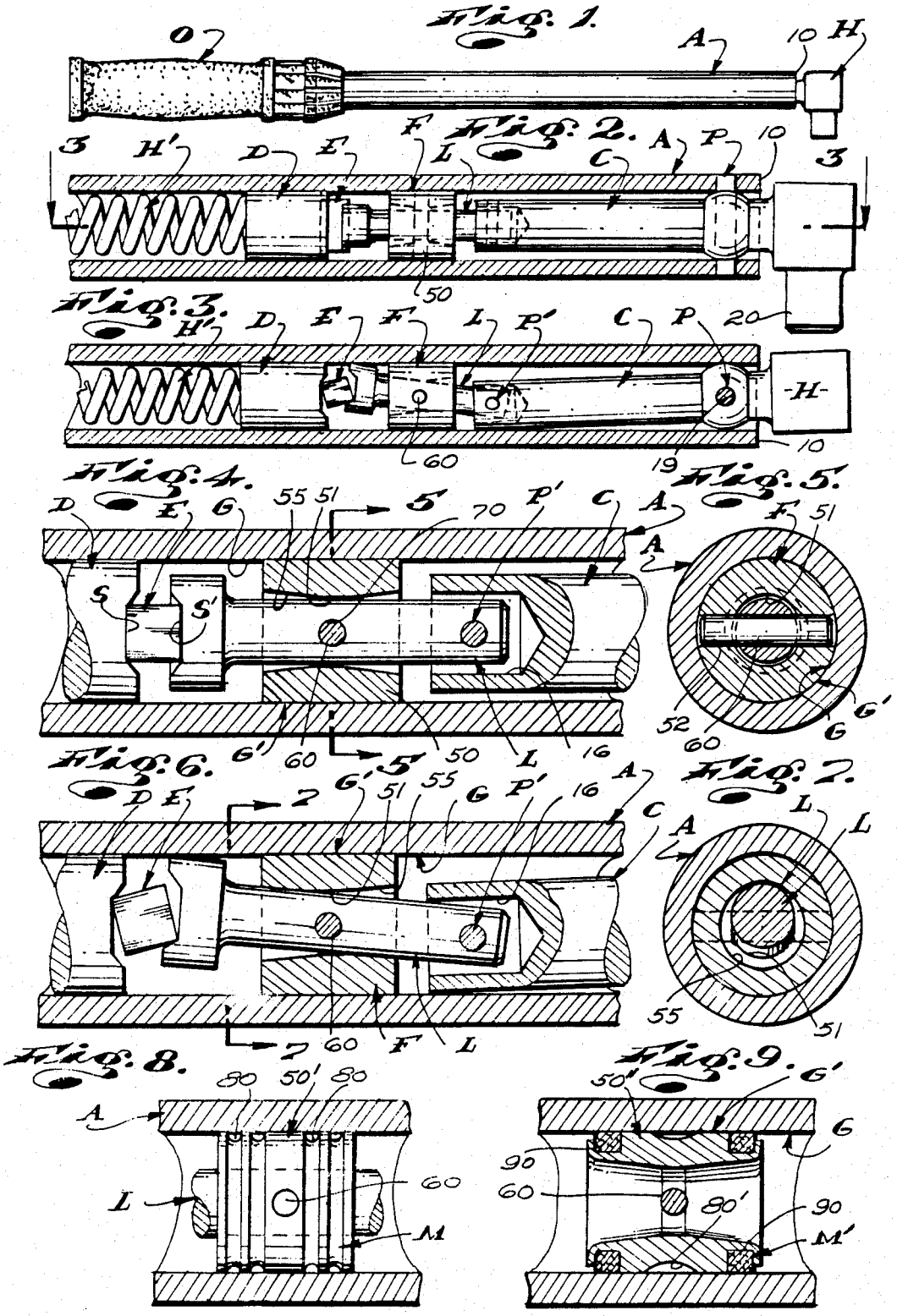
FIG. 1 is a side elevational view of a wrench embodying our invention.
FIG. 2 is an enlarged sectional view of a portion of the structure shown in FIG. 1.
FIG. 3 is a view taken substantially as indicated by line 3—3 on FIG. 2 and showing parts in another position.
FIG. 4 is an enlarged sectional view of a portion of the structure shown in FIG. 2.
FIG. 5 is a sectional view taken as indicated by line 5—5 on FIG. 4.
FIG. 6 is a view similar to FIG. 4 showing the parts in another position.
FIG. 7 is a sectional view taken as indicated by line 7—7 on FIG. 6.
FIG. 8 is a view showing one form of lubricating means.
FIG. 9 is a view showing another form of lubricating means.

The wrench structure W that we provide and which is illustrated in the accompanying drawing is, but for the form of the fulcrum structure F (which will be described in the following), the same as the basic wrench structure which is the subject matter of and which is fully disclosed in U.S. Pat. No. 3,772,942 issued Nov. 20, 1973 and which is further illustrated and described in U.S. Pat. No. 4,532,836 issued Aug. 6, 1985. The above noted patented wrench structure has been continuously produced and successfully commercially exploited since prior to the issuance of U.S. Pat. No. 3,772,942 in 1973 to this date. The noted patented wrench structure is well-known with respect to its construction and operation to all of those who are skilled in the art of torque wrenches. Accordingly, we will limit the following description of parts and portions of the basic wrench structure W which constitute prior art to a general description of those parts and portions and direct the reader's attention to the above noted U.S. Pat. Nos. 3,772,942 and 4,532,836 for more detailed description thereof, if required.

The wrench W includes an elongate tubular arm A with a front end 10 and a rear end. The rear end of the arm is provided with and carries a manually-engagable hand grip O.

The wrench W next includes a work-engaging head H adjacent the front end of the arm A. The head H is an elongate part with a central axis which is normal to the axis of the arm A and which has a polygonal portion 20 to releasably engage and carry drive sockets or the like to drivingly couple the head with screw fastener parts and the like (not shown).

The head H includes or is fixed to and carried by the front end of an elongate crank arm or lever C. The lever C projects rearwardly from the head and freely into and through the forward end portion of the arm A. The front end portion of the lever is pivotally connected to the front end portion of the arm by a first pivot pin P. The pivot pin P is engaged in and through registering openings 18 and 19 in the arm and the lever. The axis of the pin P is parallel with and spaced rearward from the axis of the head H.

The rear end portion of the lever can be formed with a rearwardly opening slot or, as shown, with a socket-like opening 16 to accommodate the front end of a related link L.

The link L is an elongate cylindrical part with front and rear ends and is freely positioned within the arm A rearward of the lever C. The front end portion of the link enters the opening 16 in the rear of the lever and is pivotally connected thereto by a second pivot pin P' engaged in and through registering openings in the lever and the link. The axis of the pin P' is parallel with and spaced rearward from the axis of the pin P.

The rear end of the link is formed with a flat, normally rearwardly-disposed cam seat S'.

The link is pivotally supported between its front and rear ends by the above referred to fulcrum structure F, the details of which will be described in the following.

The wrench structure next includes an elongate cylindrical plunger D within the arm A in rearward-spaced relationship from the link L. The front end of the plunger D is formed with a flat, forwardly-disposed cam seat S'.

The wrench W next includes a cam block E with flat, normally forwardly- and rearwardly-displosed front and rear cam faces normally establishing flat bearing engagement on and with their opposing front and rear cam seats S and S' on the link L and plunger D.

The wrench structure W next includes an elongate helical compression spring H' in the arm A rearward of and engaging the plunger D to normally yieldingly urge the plunger D forward toward the rear end of the link L, with the front and rear cam faces of the cam block E held in flat pressure seated engagement with the cam seats S and S'.

The wrench W also includes operating means (not shown) at and/or within the rear portion of the arm A and engaging the rear end of the spring H' to vary axial compression or biasing of the spring H' and to thereby set the forces directed axially through and between the plunger D, cam block E and link L. In accordance with common practice, the hand grip O is a part of the referred operating means and is such that, when turned relative to the arm A, a screw part coupled therewith is turned to adjust the biasing of and force exerted by the spring H'. The extent to which the spring is biased determines the operating force of the wrench. The operating means can, in accordance with common practice, include calibrated means which effectively indicates and translates the extent to which the spring is biased to the operating force of the wrench.

Since the above noted operating means can vary widely without in any way affecting or departing from the spirit of our invention, we will not burden this disclosure with detailed illustration and description thereof.

The wrench structure W illustrated in the drawings and thus far described is essentially and substantially identical with the prior art wrench structure disclosed in detail in U.S. Pat. No. 3,772,942.

The only major differences between the above noted patented wrench and the wrench of the present invention resides in the structure and rule of action or function of the above referred to fulcrum structure F.

(The fulcrum blocks in the noted patented wrenches are elongate sleeves slidely engaged on and about their related links and are formed with semi-spherical or annular exterior bearing surfaces or edges which establish pivoting and sliding bearing engagement with the interior, cylindrical bearing surfaces of their related arms.)

The fulcrum structure F of our invention includes an elongate cylindrical bearing or fulcrum block 50 with a central longitudinal opening 51 in and through which the link L is engaged with close but free running clearance.

The fulcrum block 50 has a cylindrical exterior bearing surface G' which is in sliding bearing engagement with the opposing interior bearing surface G in the arm A.

The longitudinal extent of the block B is at least equal to and is preferably greater than the radial extent of the block and is, therefore, such that it is self-aligning in the arm A and is not subject to turning from alignment therein and becoming bound or locked therein in a manner likely to impede longitudinal or axial shifting of the block within the arm. That is, the opposite ends of the block are spaced longitudinally outward from the central radial plane of the block a sufficient distance so that they occur longitudinally outward of an inclined plane extending through the axis of the block, intermediate the ends thereof, at an angle of greater than 45° from said central axis thereof.

The block 50 has a pair of axially-aligned through-openings 52 intermediate its ends, at opposite sides thereof. The openings 52 are on axes spaced rearward from and parallel with the axes of the pins P' and P and the axis of the head H. The openings 52 receive and hold the opposite end portions of an elongate cylindrical fulcrum pin 60. The central portion of the pin 60 extends freely transversely through the central opening 51 in the block. In practice, the ends of the fulcrum pin 60 can be slidably engaged in the openings 50 with close turning tolerances therebetween or can be, and are preferably, snuggly engaged therein.

The central portion of the fulcrum pin 60 is slidably engaged in and through a transverse bearing opening 70 in the link L, in close working tolerance therewith and for free pivotal movement or turning of the block on and about the pin 60 and relative to the block 50.

As noted above, the block 50 is of substantial longitudinal extent and the opening 51 therein and through which the link L extends establishes close working clearance with and about the portion of the link L which extends through said opening 51. The close tolerance between the link L and the opening 50 is necessary to prevent lateral shifting of the link L on the pin 60 and resulting axial misalignment of the link within the wrench structure which would otherwise adversely affect the geometry and functioning of the wrench. As a result of the foregoing, the effective longitudinal extent of the opening 51 must be reduced and/or limited to an extent that it does not prevent or interfere with the necessary free pivotal movement of the link L about the pin 60 and within the block 50. In accordance with the foregoing, the opposite end portions of the central opening 50 are enlarged, as at 55, to freely accommodate their related portions of the link L when the link is pivoted about the pin 60 and within the opening 51.

In the case illustrated, the enlarged end portions 55 of the opening 50 are defined by longitudinally inwardly tapered conical bores, the inner ends of which converge with the opening 50 in close proximity to the radial plane through the block on which the axis of the pin 60 lies. In practice, the tapered angle of the enlarged end portions 55 of the opening 50 need be little more than 5° or 6° and the longitudinal extent or depth of those relieved portions is preferably such that the effective longitudinal extent of the uninterrupted portion of the opening 51, adjacent to the pin 60, is slightly less than the diametric extent of the pin 60.

If desired, the conical bores of the enlarged end portion 55 of the central opening in the block can be made to converge with each other at said central radial plane of the block 50. In such a case, the opening 51 would be a sharp, central, annular ridge with opposite flanks at an obtuse angle. To so form and establish the opening 51 requires great skill and care to properly locate such a ridge-like opening on the desired radial plane through the block and to assure establishing it to the proper diametric size.

In practice, the working clearance or tolerance between the opening 51 and the link L is not so critical that sufficient working clearance therebetween occurs to enable pivoting and turning of the link through, for example, 5° in either direction, from center. Accordingly, the enlarged or relieved end portions 55 need not be made to converge at the noted central radial plane of the block, but can converge with the opening 50 just short of said plane, thereby making manufacture of the block and the maintaining of satisfactory working tolerances both easy and economical.

If desired, the enlarged or relieved opposite end portions 55 of the opening 51 could be made oblong in crossed sections with their minor radial axes equal with and their major radial axes greater than the diameter of the opening 50, without departing from the spirit of my invention.

When the wrench structure that we provide is operated and the lever C is pivoted from central alignment within the arm A, about the pivot pin P, to either of its two actuated positions where its rear end stops against the inside surface G of the arm and the link L is pivoted from central alignment in the structure about the axis of the fulcrum pin 60, the distance between the radial planes within the structure on which the pins P and P′ and between which the pin P′ and pin 60 occur, is reduced or lessened a slight amount. The combined lessening of the noted distances between the several pins causes and results in longitudinal forward movement of the block 50 in the arm A an appreciable distance which, though not great, is sufficient to create substantial frictional resistance and wear which, if not taken proper account of and if not properly dealt with, can result in seriously adversely affecting the intended and sought for accuracy and dependable operation of the wrench structure. With the structure that we provide and have thus far described, the above noted longitudinal shifting of the block 50 within and relative to the arm A is most effectively taken account for and is most effectively dealt with.

The only matter yet to be considered is the effective lubricating of the block and the arm to assure free movement therebetween and, of equal importance, to prevent the introduction of contaminants therebetween which might interfere with relative movement of the parts and/or degradation of the parts in a manner which might interfere with their intended operation.

In some instances and in certain environments, the application or depositing of a suitable lubricant between the surfaces G and G′, shown in FIGS. 2–6 of the drawings, is adequate. It is, however, important that the lubricant be such that it does not carry or contain any material likely to attack or cause damage to the bearing surfaces. The most common and serious contaminant likely to be found in the lubricant is water. Water is likely to cause oxidation of the metal bearing surfaces and ultimately bring about adverse effects. The next most common contaminant found in petroleum-based lubricants is sulfur. Sulfur tends to absorb water from the ambient atmosphere and reacts with the water to make sulfuric acid. The acid attacks the metal bearing surfaces and results in interference with the free and dependable operation of the wrench. In accordance with the foregoing, it is important in this structure that the lubricant be deposited between the bearing surfaces G and G′ be maintained therebetween and that it be such that it repel water. It is also important that it be free of sulfur or any other ingredient or element that is likely to absorb water and otherwise cause or support any chemical reaction which is likely to result in damage to the bearing surfaces. In accordance with the above, the lubricants that we use in carrying out our invention are anhydrous oils and/or greases. Those anhydrous oils and greases that we are aware of repel water and are not subject to causing and/or supporting any chemical reaction which might attack the bearing surfaces G and G′ and thereby adversely affect the operation of the wrench structure.

In many environments wherein considerable moisture (water) is present and/or where wide temperature variations are encountered, there is a tendency for the lubricant to be flushed and/or displaced from between the surfaces G and G′ by the migration of water therebetween and/or caused to become thin and flow from between the surfaces G and G′ when warmed or heated. Accordingly, in the carrying out of our invention and as shown in FIGS. 8 and 9 of the drawings, we provide our new wrench structure with suitable lubricating means to effect and maintain proper lubrication between the opposing bearing surfaces G and G′ of the arm and block.

In FIG. 8 of the drawings we have shown a lubricating means M which consists of a plurality of annular, grease-retaining grooves 80 machined in and about the exterior of the fulcrum block 50. The number, placement and accumulated volumetric extent of the grooves 80 is such that a sufficient volume of anhydrous grease is carried by the block (within the grooves 80) to assure the maintenance of adequate lubricant between the block and the arm for a period of time greater than the normal, useful life expectancy of the wrench, when the wrench is used in most common environments.

In FIG. 9 of the drawings, we have shown another form of lubricating means M′ which includes annular sealing-wiper rings 90 carried in annular channels formed about the opposite ends of the fulcrum block 50″. The rings 90 can be resilient rubber-like O-rings or, as shown, can be porous lubricant-saturated wiping and sealing-rings. In either case, the rings are in wiping engagement with the bearing surface G in the arm A, longitudinally outward from the opposite ends of the area of bearing engagement between the surfaces G and G′. In this form of lubricating means, a light anhydrous lubricating oil, such as "turbine oil," which provides a very thin deposit of lubricant throughout a wide range of temperatures and is not subject to becoming unduly hard and stiff at extremely low temperatures, as most grease-like lubricants are, can be effectively used. Porous lubricant-saturated wiping rings 90 carry a substantial volume and supply of lubricant and act as wicks to move that lubricant to the surface G. Such rings are such that, when the material of which they are established is once coated with a water repellent lubricant, water cannot permeate or enter the pores and/or intercices formed therein.

When the rings 90 are in the form of or are simple rubber O-rings, the exterior of the fulcrum block 50″ can be provided with one or more grooves 80′, spaced between the rings to accommodate and hold a supply of lubricating oil.

Having described only typical preferred forms and embodiments of our invention, we do not wish to be limited to the specific details herein set forth, but wish to reserve to ourselves any modifications and/or variations that might appear to those skilled in the art and which fall within the scope of the following claims.

Having described our invention, we claim:

1. A torque wrench comprising an elongate manually-engagable lever arm with a cylindrical interior bearing surface and front and rear ends, an elongate work-engaging head at the front end of the arm on an axis normal to the axis of the arm, an elongate lever projecting rearwardly from the head and freely into the arm, a first pivot pin pivotally connecting the front end portion of the lever to the front end portion of the arm on an axis spaced rearward from and parallel with the axis of the head, an elongate link with front and rear ends positioned freely within the arm rearward of the lever, a second pivot pin pivotally connecting the front end of the link to the rear end of the lever on an axis spaced rearward from and parallel with the first pivot pin, a rearwardly-disposed front cam seat at the rear end of the link, an elongate fulcrum block with a cylindrical exterior bearing surface and a central longitudinal opening, said fulcrum block is engaged freely about the link between the ends thereof and is positioned in the arm rearward of the lever with its exterior bearing surface in sliding bearing engagement with said interior bearing surface of the arm, an elongate fulcrum pin carried by the fulcrum block between the ends thereof and engaged through and pivotally coupling the link with the block on an axis spaced rearward from and parallel with the axis of said second pivot pin, an elongate plunger with front and rear ends slidably engaged in the arm rearward of the link, a forwardly disposed rear cam seat at the front end of the plunger a cam block with forwardly- and rearwardly-disposed cam faces normally establishing flat bearing engagement with front and rear cam seats on the link and the plunger, a radially outwardly opening channel in the fulcrum block and a deposit of lubricant in the channel and in contact with said interior bearing surface, a spring means in the arm rearward of and yieldingly urging the plunger forward and holding the plunger, cam block and link in pressure engagement with each other, said plunger, link, fulcrum block and lever are normally axially aligned within the arm, said lever and link pivot about said first pivot pin and fulcrum pin and said plunger and fulcrum block move longitudinally in the arm when the wrench is operated.

2. The torque wrench set forth in claim 1 wherein said central opening in the fulcrum block has a central portion of reduced diameter through which the fulcrum pin extends and through which said link extends in close running clearance therewith, said central opening has longitudinally outwardly divergent and longitudinally outwardly opening opposite end portions to accomodate the link when the link is pivoted about the fulcrum pin within the block.

3. The torque wrench set forth in claim 1 wherein the fulcrum block is equal in longitudinal extent with its radial extent.

4. The torque wrench set forth in claim 1 wherein the fulcrum block is greater in longitudinal extent than in radial extent.

5. The torque wrench set forth in claim 1 wherein said central opening in the fulcrum block has a central portion of reduced diameter through which the fulcrum pin extends and through which said link extends in close running clearance therewith, said central opening has longitudinally outwardly divergent and longitudinally outwardly opening opposite end portions to accommodate the link when the link is pivoted about the fulcrum pin within the block, the longitudinal extent of the fulcrum block is equal to its radial extent.

6. The torque wrench set forth in claim 1 wherein said central opening in the fulcrum block has a central portion of reduced diameter through which the fulcrum pin extends and through which said link extends in close running clearance therewith, said central opening has longitudinally outwardly divergent and longitudinally outwardly opening opposite end portions to accommodate the link when the link is pivoted about the fulcrum pin within the block, the longitudinal extent of the fulcrum block is greater than its radial extent.

7. A torque wrench comprising an elongate manually-engagable lever arm with a cylindrical interior bearing surface and front and rear ends, an elongate work-engaging head at the front end of the arm on an axis normal to the axis of the arm, an elongate lever projecting rearwardly from the head and freely into the arm, a first pivot pin pivotally connecting the front end portion of the lever to the front end portion of the arm on an axis spaced rearward from and parallel with the axis of the head, an elongate link with front and rear ends positioned freely within the arm rearward of the lever, a second pivot pin pivotally connecting the front end of the link to the rear end of the lever on an axis spaced rearward from and parallel with the first pivot pin, a rearwardly-disposed front cam seat at the rear end of the link, an elongate fulcrum block with a cylindrical exterior bearing surface and a central longitudinal opening, said fulcrum block is engaged freely about the link between the ends thereof and is positioned in the arm rearward of the lever with its exterior bearing surface in sliding bearing engagement with said interior bearing surface of the arm, an elongate fulcrum pin carried by the fulcrum block between the ends thereof and engaged through and pivotally coupling the link with the block on an axis spaced rearward from and parallel with the axis of said second pivot pin, an elongate plunger with front and rear ends slidably engaged in the arm rearward of the link, a forwardly disposed rear cam seat at the front end of the plunger, a cam block with forwardly and rearwardly-disposed cam faces normally establishing flat bearing engagement with front and rear cam seats on the link and the plunger, said fulcrum block has radially outwardly annular grooves at its opposite ends and annular sealing and wiping rings are engaged in said grooves and project therefrom into sealing wiping engagement with said interior bearing surface, a spring means in the arm rearward of and yieldingly urging the plunger forward and holding the plunger, cam block and link in pressure engagement with each other, said plunger, link, fulcrum block and lever are normally axially aligned within the arm, said lever and link pivot about said first pivot pin and fulcrum pin and said plunger and fulcrum block move longitudinally in the arm when the wrench is operated.

8. The torque wrench set forth in claim 7 wherein said central opening in the fulcrum block has a central portion of reduced diameter through which the fulcrum pin extends and through which said link extends in close running clearance therewith.

9. The torque wrench set forth in claim 7 wherein said central opening in the fulcrum block has a central portion of reduced diameter through which the fulcrum pin extends and through which said link extends in close running clearance therewith, said central opening has longitudinally outwardly divergent and longitudinally outwardly opening opposite end portions to accommodate the link when the link is pivoted about the fulcrum pin within the block, the longitudinal extent of the fulcrum block is greater than its radial extent, said fulcrum block has a radially outwardly opening channel entering said outer bearing surface and opening toward said interior bearing surface of the arm and a deposit of lubricant is in said groove.

10. The torque wrench set forth in claim 7 wherein said wiping rings are saturated with lubricant and occur longitudinally outward of the opposite ends of the longitudinal portion of the interior bearing surface in the arm that is contacted by the exterior bearing surface of the block.

11. The torque wrench set forth in claim 7 wherein said central opening in the fulcrum block has a central portion of reduced diameter through which the fulcrum pin extends and through which said link extends in close running clearance therewith, said central opening has longitudinally outwardly divergent and longitudinally outwardly opening opposite end portions to accommodate the link when the link is pivoted about the fulcrum pin within the block, the longitudinal extent of the fulcrum block is greater than its radial extent, said fulcrum block has a radially outwardly opening channel entering said outer bearing surface and opening toward said interior bearing surface of the arm and a deposit of lubricant in said groove, said sealing and wiping rings occur longitudinally outward of the opposite ends of the longitudinal portion of the interior bearing surface in the arm that is contacted by the exterior bearing surface of the block.

* * * * *